US006021302A

United States Patent [19]

Janssens et al.

[11] Patent Number: 6,021,302

[45] Date of Patent: Feb. 1, 2000

[54] DEVICE FOR ELECTROSTATICALLY TRANSFERRING COLOR TONER IMAGES ONTO AN ELECTRICALLY GROUNDED RECEPTOR SHEET

[75] Inventors: Robert Janssens, Geel; Werner Heirbaut, Sint-Niklaas; Peter Baeyens, Melsele, all of Belgium

[73] Assignee: Agfa-Gevaert, Mortsel, Belgium

[21] Appl. No.: 08/908,574

[22] Filed: Aug. 8, 1997

Related U.S. Application Data

[60] Provisional application No. 60/027,505, Sep. 27, 1996.

[30] Foreign Application Priority Data

Aug. 9, 1996 [EP] European Pat. Off. ..... 96202251

[51] Int. Cl.[7] ..... G03G 15/01

[52] U.S. Cl. ..... 399/315; 399/300; 399/310

[58] Field of Search ..... 399/303, 310–315, 399/306, 298, 300, 304, 309, 299, 40, 39

[56] References Cited

U.S. PATENT DOCUMENTS

| | | | |
|---|---|---|---|
| 4,110,027 | 8/1978 | Sato et al. | 399/312 X |
| 5,081,501 | 1/1992 | Waki et al. | 399/303 |
| 5,189,479 | 2/1993 | Matsuda et al. | 399/300 |
| 5,268,725 | 12/1993 | Koga et al. | 399/312 |
| 5,406,359 | 4/1995 | Fletcher | 355/273 |
| 5,740,508 | 4/1998 | Matsuura et al. | 399/308 |
| 5,771,432 | 6/1998 | Nakayama | 399/310 |

FOREIGN PATENT DOCUMENTS

| | | |
|---|---|---|
| 0400986 | 7/1995 | European Pat. Off. . |
| 6-161298 | 6/1994 | Japan . |
| 8-30163 | 2/1996 | Japan . |

OTHER PUBLICATIONS

Opinion by International Preliminary Examining Authority relating to PCT application No. PCT/EP 97/04330 claiming priority of P 96 20 2251.3, dated Apr. 27, 1998.

*Primary Examiner*—Arthur T. Grimley
*Assistant Examiner*—Quana Grainger
*Attorney, Agent, or Firm*—Baker & Botts, L.L.P.

[57] ABSTRACT

An apparatus for transferring a plurality of toner images having a charge thereon from a photoconductive member to a receptor sheet, the transferring device including a first corona generator for applying a charge to the sheet of polarity opposite to that of the charge on the corresponding toner image and for transferring the toner image from the member to the sheet, a second corona generator, located after the first corona generator, for applying a charge to the toner image on the sheet of a polarity equal to that of the charge on the toner image for increasing the charge thereof, and a grounding electrode opposite to the second corona generator for electrically grounding the opposite side of the receptor sheet.

18 Claims, 3 Drawing Sheets

DEVICE FOR ELECTROSTATICALLY TRANSFERRING COLOR TONER IMAGES ONTO AN ELECTRICALLY GROUNDED RECEPTOR SHEET

This application claims the benefit of U.S. Provisional Application No. 60/027,505 filed Sep. 27, 1996.

BACKGROUND OF THE INVENTION

1. Field of the Invention

The present invention relates to colour electrostatography in general, and more particularly to a device for improving transfer of successive, different colour toner images in superimposed registration with one another on a receptor sheet.

2. Description of the Prior Art

In an electrophotographic printing machine, a photoconductive member is charged to a substantially uniform potential to sensitize the surface thereof. The charged portion of the photoconductive member is image-wise exposed. Exposure of the charged photoconductive member selectively dissipates the charges thereon in the irradiated areas. As a result, an electrostatic latent image is recorded on the photoconductive member corresponding to the informational areas contained in the original document being reproduced. After the electrostatic latent image is recorded on the photoconductive member, the latent image is developed by bringing toner into contact therewith. This forms a developed toner image on the photoconductive member which is subsequently transferred to a copy sheet. The copy sheet is heated to permanently affix the toner image thereto in image configuration.

Multicolour electrophotographic printing is substantially identical to black and white printing. However, rather than forming a single latent image on the photoconductive surface, successive latent images corresponding to different colours are recorded thereon. Each single colour electrostatic latent image is developed with toner of a colour complementary thereto. This process is repeated a plurality of cycles for differently coloured images and their respective complementarily coloured toner. Each single colour toner image is transferred to the copy sheet in superimposed registration with the prior toner image, thereby creating a multilayered toner image on the copy sheet. Thereafter, the multi-layered toner image is permanently fixed to the receptor sheet creating a colour copy or print. The developer material may be a liquid material or a powder material.

In order to successfully transfer different colour toner images to the sheet, the sheet can move in a path enabling successive different colour images to be transferred thereto. In this way the different colour toner images (e.g. magenta, cyan, yellow and black toner images) are transferred to the sheet. A corona generator may be used to charge the sheet to attract the toner images thereto. However, there is a significant reduction in transfer efficiency when attempting to transfer toner images to a location on the sheet having a toner image previously transferred thereto. Moreover, when more than one colour toner is used to develop a line, the transferred line is blurred. Also, transfer may be mottled and non-uniform.

One device for improving transfer of toner images in colour electrophotography is disclosed in U.S. Pat. No. 5,059,990. This device comprises one corona generator for applying a charge to the sheet of a polarity opposite to that of the charge on the toner image for transferring the toner image from the member to the sheet, another corona generator located after the first one and in the direction of movement of the sheet, for applying a charge to the sheet of a polarity which is the same as that of the charge on the toner image to assist in separating the sheet from the member, still another corona generator for applying a charge on the transferred toner image of a polarity opposite to that of the toner image, and means for electrically grounding the sheet as the latter corona generator applies the charge on the toner. The latter corona has a neutralizing effect on the transferred toner image.

We have found that this system has the disadvantage that in micro areas where unusually large amounts of toner are transferred, small amounts of toner on the sheet will get a reverse polarity. This causes back transfer of toner to the photoconductive member in a next toner image transfer station which of course is not desired.

SUMMARY OF THE INVENTION

Objects of the Invention

It is one object of the present invention to reduce back transfer of toner from the sheet to the photoconductive member.

It is a further object to reduce blurring of multicolour lines on the copy sheet.

A still further object of the invention is a reduction of the number of corona generators in a colour printer in order to reduce ozon production, maintenance costs and to increase the reliability of the machine.

Statement of Invention

In accordance with the present invention, a device for transferring a plurality of toner images having a charge thereon from a member to a sheet, comprising:

- means for moving the sheet in a direction such that the sheet moves in synchronism with the member in a path enabling successive toner images to be transferred to one side of the sheet in superimposed registration with each other, and for each distinct toner image:
- transfer means for applying a charge to the side of the sheet opposite said one side of a polarity opposite to that of the charge on the toner image for transferring the toner image from the member to the sheet,
- charge generating means located after said transfer means in the direction of movement of the sheet, at a position at which the sheet has become separated from said member and at said one side of said sheet, for applying a charge on the toner image on the sheet, and
- grounding means opposite to said charge generating means for electrically grounding the opposite side of the sheet, is characterised in that said charge generating means is arranged for applying a charge on the transferred toner image on the sheet during the complete toner image transfer, and of a polarity equal to that of the charge on the toner image for increasing the charge thereon, so as to produce an increase of its toner voltage and causes thereby a notable decrease of back transfer of toner from the sheet to the member in a next transfer station.

Further we have found that careful adjustment of the charge on the toner image reduces blurring of multicolour lines, composed of toner particles of different colour on top of each other.

Blurring occurs when, in subsequent transfer steps, lines, composed of toner particles of different colour but of the same polarity, are to be positioned exactly on top of each other. In this case, toner particles of a previous line are repelling toner particles of a next line, causing a dispersion of toner particles at the edges of the line giving rise to blurred, not well-defined edges but of the same polarity in the image.

Charge generating means disposed after image transfer means are known from EP-A-298 505 and 400 986. In these instances, the arrangement is operative to discharge the sheet, and/or operative only when a trailing edge of the sheet is substantially immediately before a transfer zone.

Suitable embodiments of a device according to the invention are as follows.

According to one embodiment, the device comprises a second arrangement of transfer means, charge generating means and grounding means, the locations of which are reversed with respect to said respective sheet sides, for processing successive toner images transferred to said opposite side of the sheet. In this way a duplex image can be produced.

The transfer of toner images to said opposite side of the sheet can occur after transfer of all of the toner images to said one side of the sheet, but successive transfers, viz. one to the one sheet side, a next to the opposite sheet side, a still next to the one sheet side, etc. according to an interwoven relationship, is possible as well.

It is advantageous to first carry out the transfer of all the distinct toner images, and next fusing them. In this way, the machine may be more compact and energy may be saved.

According to another embodiment, the charge generating means can be controlled to apply a charge to the sheet, the magnitude of which increases with the number of toner images that have been transferred already to the sheet. We have found that this is an important measure for improving image quality. As a matter of fact, the voltage on the toner surface increases with the number of toner image transfers, and it is important to adapt the magnitude of the voltage produced by the charge generating means to compensate for the increased toner surface voltage.

According to still another embodiment, the device comprises a corona generator located after the transfer means in the direction of movement of the sheet and at the point of separation of the sheet from the member, to discharge the sheet. This can be cone by applying a charge to the sheet of a polarity which is opposite to that of the charge on the toner image to assist in separating the sheet from the member. This feature can be required if the separation of the sheet from the member raises difficulties.

According to a still further embodiment, the device can comprise means for determining a path for the member which is curved away from the path of the sheet with a radius smaller than 50 mm. A strongly curved path for the member greatly enhances the reliability of separation of the sheet from the member. This depends also on the stiffness of the sheet. A less stiff paper sheet may require a smaller radius of curvature of the member. For common paper with a weight of approximately 100 g.m2, it may be desirable to use a radius smaller than 50 mm. Using a strongly curved path for the member, it is possible to dispense with the so-called detack corona generator known in the art used to separate the sheet from the member. It is clear that, as the number of corona generators in the apparatus goes down, reliability will increase.

The meaning of the term "member" as used in the statement therebefore is not limited to a photoconductor. It should be understood that any member, whether in the form of a roller surface, a belt or the like, and capable of bearing on its surface an electrostatic charge pattern which after electrostatic development yields a toner image that can be transferred to a receptor sheet, is within the scope of the present invention. Thus, also electrostatic printing systems in which electrostatic charges are directly sprayed onto an insulating support to create an electrostatic charge image are within the scope of the present invention.

The term "sheet" as used in the present specification stands for a receptor in the form of a separate sheet, as well as for one in the form of a web. The material of such sheet may be paper, plastic, a laminate of both, or the like.

A still further embodiment of the present invention is one in which the transfer means is formed by a transfer roller.

BRIEF DESCRIPTION OF THE DRAWINGS

The invention will be described hereinafter by way of example with reference to the accompanying drawings, wherein.

DETAILED DESCRIPTION OF THE INVENTION

Figure 1:
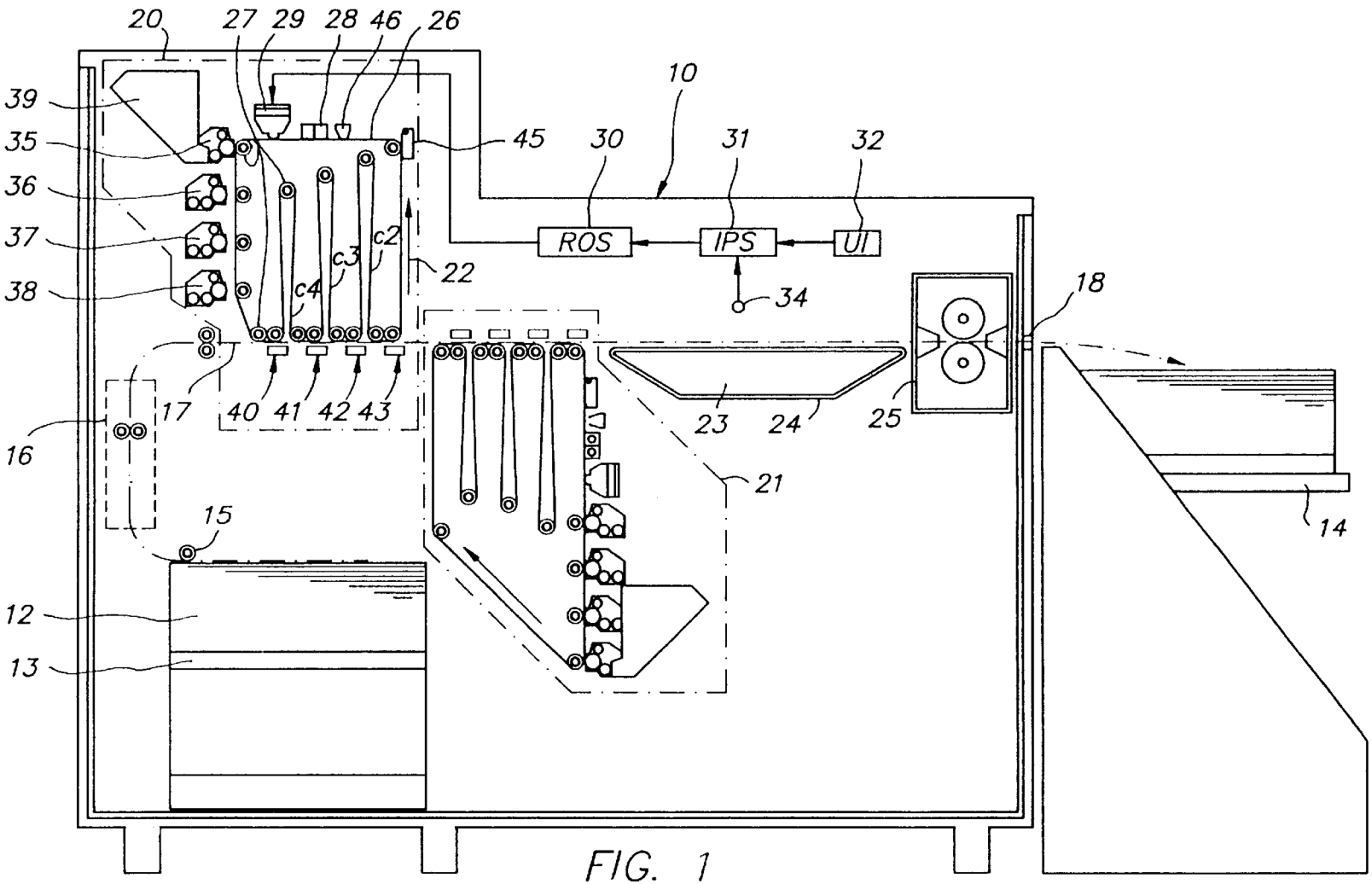
FIG. 1 is a diagrammatic view of one embodiment of a duplex printer embodying toner transfer devices according to the present invention.

FIG. 1 shows a diagrammatic representation of one embodiment of an electrophotographic duplex printer.

The printer comprises a lighttight housing 10 which has at its inside a stack 12 of sheets to be printed loaded on a platform 13 the height of which is adjusted in accordance with the size of the stack, and at the outside a platform 14 onto which the printed sheets are received.

A sheet to be printed is removed from stack 12 by a dispensing mechanism 15 which may be any mechanism known in the art such as a friction roller, a friction pad, or the like for removing the top sheet from stack 12.

The removed sheet is passed through an alignment station 16 which ensures the longitudinal and lateral alignment of the sheet. As the sheet leaves the alignment station, it follows a straight horizontal path 17 up to outlet 18 of the printer.

The following processing stations are located along said path. A first image forming station 20 for applying a colour image to the obverse side of the sheet and a second station 21 for applying a colour image to the reverse sheet side. A buffer station 23 with an endless belt 24 for transporting the sheet to fuser station 25 while allowing the speed of the sheet to decrease because the speed of fuser 25 is lower than the speed of image formation.

Both image forming stations 20 and 21 being equal to each other, only station 20 will be described in more detail hereinafter.

An endless photoconductor belt 26 is guided over a plurality of idler rollers 27 to follow a path in the direction of arrow 22 to advance successive portions of the photoconductive surface sequentially through the various processing stations disposed about the path of movement thereof. The belt suitably can be a polyethylene terephthalate support which is provided at the outside of its loop with a subbing layer onto which a photoconductive layer has been coated. Means is provided (not shown) for driving the belt at a uniform speed and for controlling its lateral position.

Initially, a portion of photoconductive belt 26 passes through charging station 28. At the charging station, a corona generating device electrostatically charges the belt to a relatively high, substantially uniform potential. Next, the belt is rotated to the exposure station 29. The exposure station includes a ROS (raster output scanner) 30 with a laser with a rotating polygon mirror block which creates the output printing image by laying out the image in a series of horizontal scan lines, each line having a given number of pixels per inch. Station 29 will expose the photoconductive belt to successively record four latent colour separation images. The latent images are developed with magenta, cyan, yellow and black developer material, respectively. These developed images are transferred on the print sheet in superimposed registration with one another to form a multicolour image on the sheet. The ROS receives its input signal from IPS (image processing system) 31. This system is the electronic control device which prepares and manages the data inflow to scanner 30. A user interface UI, indicated by reference numeral 32, is in communication with the IPS and enables the operator to control the various operator adjustable functions. IPS 31 receives its signal from input 34. This input can be the output of a RIS (raster input scanner) in case the apparatus is a so-called intelligent copier. In such case, the apparatus contains document illumination lamps, optics, a mechanical scanning drive, and a charge-coupled device. The RIS captures the entire original document and converts it to a series of raster scan lines and measures a set of primary colour densities, i.e. red, green and blue densities at each paint of the original document. However, input 34 can as well receive an image signal resulting from an operator operating an image processing station.

After an electrostatic latent image has been recorded on photoconductive belt 26, belt 26 advances this image to the development station. This station includes four individual developer units 35, 36, 37 and 38.

The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the brush of developer material into contact with the photoconductive surface. Developer units 35, 36 and 37, respectively, apply toner particles of a specific colour which corresponds to the complement of the specific colour-separated electrostatic latent image recorded on the photoconductive surface. The colour of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 10, while the green areas will be reduced to a voltage level ineffective for development. The charged areas are than made visible by having developer unit 35 apply green absorbing (magenta) toner particles onto the electrostatic latent image recorded on photoconductive belt 26. Similarly, a blue separation is developed by developer unit 36 with blue absorbing (yellow) toner particles, while the red separation is developed by developer unit 37 with red absorbing (cyan) toner particles. Developer unit 38 contains black toner particles and may be used to develop the electrostatic latent image formed from black information or text, or to supplement the colour developments. Each of the developer units is moved into and out of an operative position. In the operative position, the magnetic brush is closely adjacent to the photoconductive belt, whereas in the non-operative position, the magnetic brush is spaced therefrom. During development of each electrostatic latent image only one developer unit is in the operative position, the remaining developer units being in their non-operative one. This insures that each electrostatic latent image is developed with toner particles of the appropriate colour without intermingling. In FIG. 1, developer unit 35 has been shown in its operative position. Finally, each unit comprises a toner hopper, such as hopper 39 shown for unit 35, for supplying fresh toner to the developer which becomes progressively depleted by the development of the electrostatic charge images.

After their development, the toner images are moved to toner image transfer stations 40, 41, 42 and 43 where they are transferred on a sheet of support material, such as plain paper or a transparent film. At a transfer station, a sheet follows a rectilinear path 17 into contact with photoconductive belt 26. The sheet is advanced in synchronism with the movement of the belt. Transfer of a toner image from the belt to the sheet will be described in greater detail in FIGS. 2*a*, 2*b* and 2*c* hereinafter. After transfer of the four toner images, the belt following an upward course is cleaned in a cleaning station 45 where a rotatable fibrous brush or the like is maintained in contact with the photoconductive belt 26 remove residual toner particles remaining after the transfer operation. Thereafter, lamp 46 illuminates the belt to remove any residual charge remaining thereon prior to the start of the next cycle.

Figure 2B:
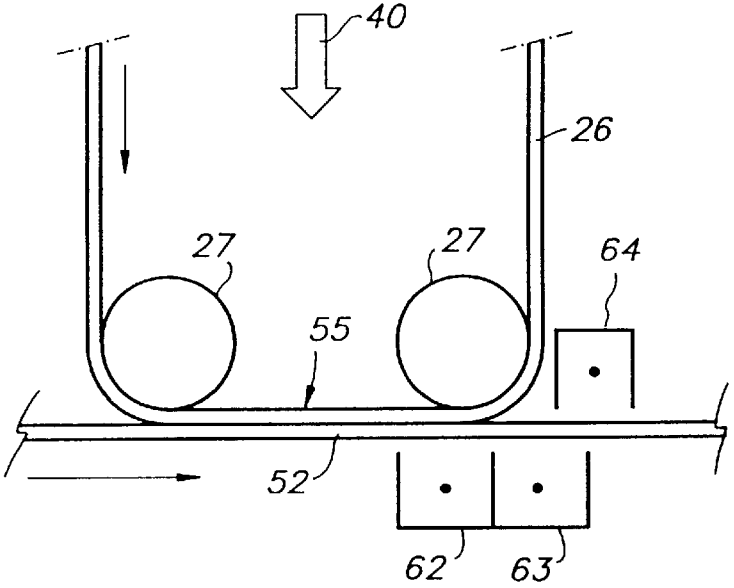
FIG. 2*b* is a detail of FIG. 1 showing another embodiment of one toner transfer station.
Figure 2A:
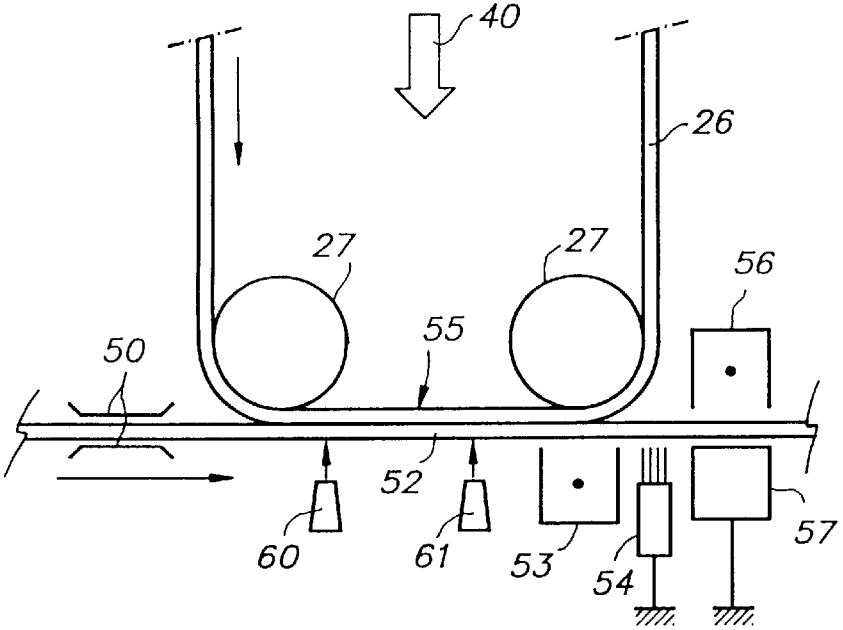
FIG. 2*a* is a detail of FIG. 1 showing one embodiment of one toner transfer station.

Referring to FIG. 2*a*, transfer station 40 of FIG. 1 is shown on an enlarged scale.

Transfer station 40 comprises idler rollers 27 for causing photoconductive belt 26 to follow a short horizontal path 55 as shown. The diameter of rollers 27 amounted to 24 mm in the present example, so that the radius of curvature of the upwardly deflected belt 26 at the right-hand roller amounted to only 12 mm. Sheet 52 has a position in contact with the belt and moves synchronously therewith as described already. The sheet is kept in contact with the belt as a consequence of electrostatic attraction forces resulting from charging the sheet with transfer corona 53. Contact of the sheet with the belt may occasionally be improved by means such as air jets produced by nozzles 60 and 61 biasing the sheet in a direction opposing gravity, by guide plates or fingers 50 determining the initial course of the paper sheet, and the like.

A first, transfer corona generator 53 is located at a position just ahead of the point of separation of the sheet from the belt and sprays ions on the rear side of the sheet so as to charge the sheet to a polarity opposite to that of the charge on the toner image on the photoconductive belt. Thus, the sheet is charged to the proper magnitude and polarity for attracting and transferring the toner image from the photoconductive belt 26 thereto. Suitable DC voltages for this generator are between 3000 and 9000 volts.

A brush-like electrode 54 serves for discharging the sheet after the toner transfer. This electrode can comprise a greet plurality of individual, conductive fibres with a diameter down to 10 micrometer that are electrically grounded and thereby are capable of establishing an electric current path with the sheet, even if they remain separated therefrom over a distance between 0.5 and 2 mm approximately.

After the toner image has been transferred to the sheet and the sheet became separated from photoconductive belt 26 a second, conditioning corona generator 56 sprays ions on the front side of the sheet so as to apply a charge on the toner image on the sheet of a polarity equal to that of the charge on the transferred toner image. In this way, the charge on this side of the sheet is increased. Corona generator 56 may be in principle any type of corona device suitable for carrying out the desired charging, but we have found that excellent results were obtained with an AC corona operating at a peak-to-peak voltage of 8 to 20 kV at a frequency of 50 to 10000 Hz, an offset to the AC high voltage wave being applied ranging between 0 and 2000 DC volts.

It should be noticed that no corona generator known in the art as "Detack" is provided in the present transfer station.

The proper operation of corona 56 requires the opposite side of the sheet to be grounded. This has been shown in the figure as occurring by means of block 57. This block 57 can be a conventional AC or DC, or a combination of AC and DC corona, a grounded plate running parallel to the sheet, an electrically conductive brush such as brush 54, a roller or the like.

The operation of the printer described hereinbefore is as follows.

The magenta latent image being exposed by station 29 on photoconductive belt 26, this image is progressively developed by station 35 being in its operative position as the belt moves therethrough. Upon completion of the end of the exposure of the magenta image, the yellow image becomes exposed. During the yellow exposure, the developed magenta image is transported past inactive stations 36, 37 and 38 while toner transfer stations 40 to 43 still are inoperative too.

As the development of the magenta latent image is finished, magenta development station 35 is withdrawn to its inoperative position and after the trailing edge of the magenta image has passed yellow development station 36, this station is put in he operative position to start the development of the yellow latent image. While the latter portion of the yellow latent image is being developed, the exposure of the cyan latent image at 29 starts already.

The described processes of imagewise exposure and colour development continue until the four colour separation images have been formed in successive spaced relationship on the photoconductive belt.

A sheet 52 which has been taken from stack 12 and kept in readiness in aligner 16, is then advanced and reaches toner transfer station 40 where at that moment the last formed toner image, viz. the black one, is ready to enter the station. Thus, the lastly formed toner image is the first to become transferred to sheet 52. The firstly formed toner image, viz. the magenta one, takes with its leading edge a position on the belt as indicated by the cross c2 and will thus be transferred last. The other two toner images take positions with their leading edges as indicated by crosses c3 and c4, respectively.

Thus, the timing of exposure of the four distinct images, the relative position of these images on the photoconductive belt and the lengths of the path of this belt between the successive transfer stations are such that as paper sheet 52 follows a linear path through these stations, the partly simultaneous transfer of the distinct toner images to the paper sheet is such that a perfect registering of these images is obtained.

The increase of the charge on the transferred toner images by conditioning corona generator 56 is responsible for a notable reduction of back transfer of toner from a toner image on the paper sheet to the photoconductive belt in a next transfer station. A toner transfer efficiency up to 97% could be obtained.

Furthermore, the adjustment of operation of the distinct conditioning corona generators is such that they apply increasing electrostatic charges to the sheet in response to the number of toner images that have been transferred already to the sheet.

The toner image transfer corona generators 53 can likewise be set to increasing voltages as the number of already transferred toner images increases, to obtain satisfactory transfer results.

Sheet 52 bearing a colour toner image on its obverse side produced as described hereinbefore, is now passed through image forming station 21 for applying a colour toner image to the reverse side of the sheet.

The sheet electrostatically bearing the colour images is then received on the endless belt 24 of buffer station 23 before entering fuser station 25.

The purpose of buffer 23 is as follows. Fuser station 25 operating to melt the toner images transferred to the sheets in order to affix them, it will be understood that this operation requires a certain minimum time since the temperature of the fuser is subject to an upper limit which must not be exceeded, unless the roller lifetime becomes unsatisfactory.

In other words, the speed of fuser station 25 is limited. The speed of the image formation stations 20 and 21, on the other hand, is in principle not limited for any particular reason. On the contrary, it is advantageous to use a high speed of image formation and image transfer, since the four colour separations of each colour image are written by exposure head 29 in succession, what means that the recording time of one colour image amounts to at least four times the recording time of one part image.

All this means a relatively high speed of photoconductive belt 26, and thus of the synchronously moving sheets, as compared with a maximum usable travelling speed through the fuser station. In the apparatus according to the present embodiment, the speed of the two photoconductive belts amounted to 295 $mm.s^{-1}$, whereas the fusing speed was 100 $mm.s^{-1}$.

The length of buffer station 23 is sufficient for receiving the largest sheet size to be processed in the apparatus.

Buffer station 23 operating initially at the speed of the photoconductive belts of devices 20 and 21, the speed of this station is reduced to the processing speed of fuser station 25 as the trailing edge of the sheet has left device 21.

Fusing station 25 can be of known construction, comprising rubber rollers heated internally or externally by radiation or convection, and the fused sheet is finally received on platform 14.

FIG. 2*b* shows another embodiment of a toner image transfer station. The arrangement shown is for station 40 but it is clear that stations 41, 42 and 43 can be identical to 40.

A transfer corona generator 62 is paired with corona generator 63. Generator 62 is a conventional D.C. transfer corona whereas 63 is an A.C. corona, a DC one or a combination of both, operating as grounding electrode for discharging the sheet as well as for forming the grounding path for corona generator 64 which operates as a conditioning generator for increasing the charge on the toner image.

Figure 2C:
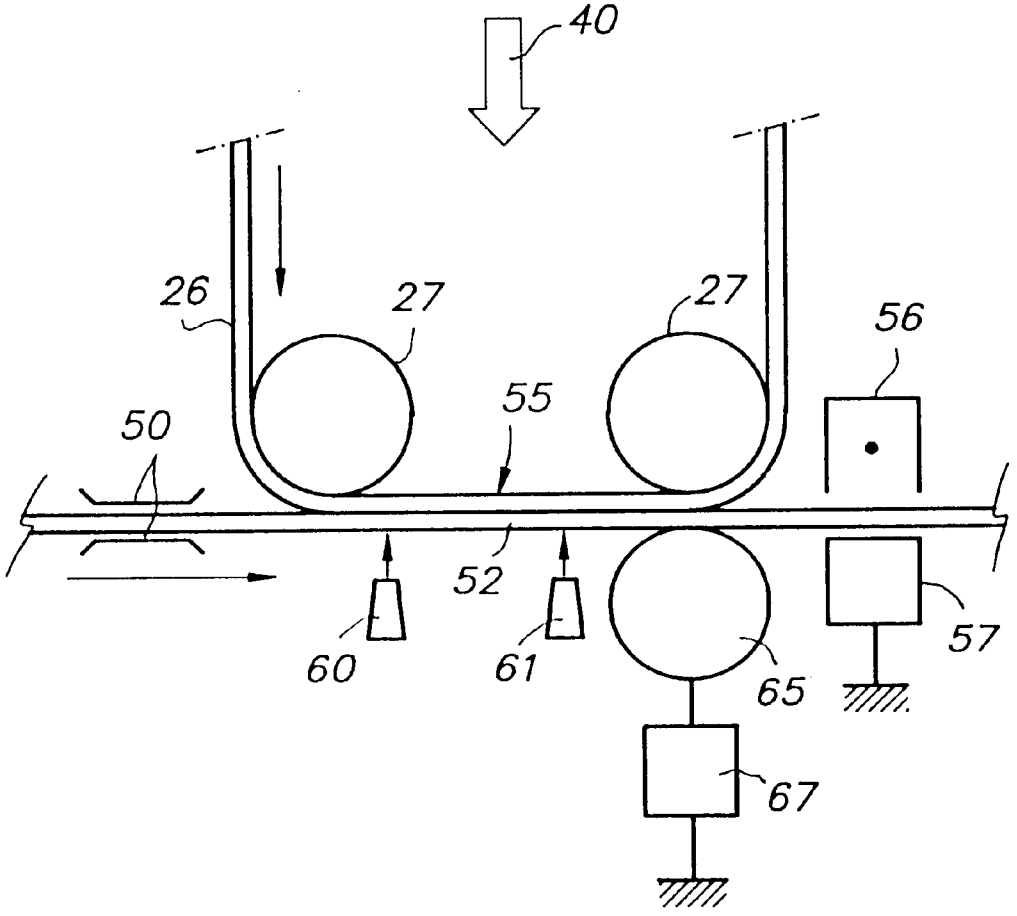
FIG. 2*c* is a detail of FIG. 1 showing still another embodiment of one toner transfer station.

FIG. 2*c* shows still another embodiment of a toner image transfer station. The transfer means is in this station formed by a conductive roller 65 connected to a suitable source 67 of DC voltage.

The invention is not limited to the embodiments described hereinbefore.

The distinct toner image transfer stations for one colour image need not necessarily co-operate with one photoconductive belt. A different arrangement is one in which two endless belts are provided, each one comprising an exposure station, two colour development and two toner image transfer stations. Such two transfer stations can be mounted closely adjacent to each other, the four image transfer stations having a mutual position as shown in FIG. 1.

A fifth transfer station may be provided, e.g. for applying a transparent covering layer, such as a varnish, on top of the already transferred toner images. Such covering layer can image-wise correspond with the colour image, but can also differ therefrom.

The transfer of the distinct toner images need not necessarily occur partly simultaneously as described hereinbefore, but can also occur completely successively. It is clear, however, that a latter arrangement is detrimental to the compactness of the machine.

The exposure station 29 can also be formed by a LED exposure bar extending transversely over the path of the photoconductive belt and comprising a great plurality of line-wise arranged LED's that are individually controllable to write an image line by line.

Sheets fed from stack 12 can occasionally be subjected to a drying operation prior to the toner image transfer, in order to get a sufficiently low moisture content, e.g. below 20%. We have found that a high(er) moisture content is unfavourable for back transfer of toner to the photoconductor. Such paper conditioning can be incorporated in alignment module 16.

We claim:

1. An apparatus for transferring a plurality of toner images from a member to a sheet, each of said toner images having a respective first charge for transferring each of said toner images from said member to said sheet, and said sheet having a first side in contact with said member and a second side facing away from said member, said apparatus comprising:

means for moving said sheet along a path in synchronism with said member a transfer device for applying a respective second charge corresponding to each of said toner images to said second side of said sheet, said second charge having a polarity opposite to that of said first charge such that successive ones of said toner images are transferred from said member to said first side of the said sheet in superimposed registration with each other;

a charge generating device, located facing said first side of said sheet and after said transfer device along said path of movement of said sheet at a position where said sheet becomes separated from said member, for applying a third charge having the same polarity as said first charge on said transferred toner images on said first side of said sheet; and grounding means, located facing said second side of said sheet and opposite said charge generating device, for electrically grounding said second side of said sheet, said charge generating device and said grounding means being arranged for increasing the charge of said transferred toner images on said first side of said sheet so as to minimize back transfer of said transferred toner images from said sheet to said member in a subsequent transfer station.

2. The apparatus according to claim 1, further comprising a second transfer device, second charge generating device and second grounding means for processing successive toner images to be transferred onto said second side of said sheet to form a duplex image.

3. The apparatus according to claim 1, wherein said transfer device is a corona device.

4. The apparatus according to claim 1, wherein said transfer device is an electrically biased roller.

5. The apparatus according to claim 1, wherein said charge generating device is a corona device.

6. The apparatus according to claim 5, wherein said corona device is an alternating current device comprising a direct current offset.

7. The apparatus according to claim 1, wherein said grounding means comprises an electrically conductive, electrically grounded brush.

8. The apparatus according to claim 1, further comprising means for discharging said sheet at a position where said sheet becomes separated from said member.

9. The apparatus according to claim 8, wherein said discharging means is an electrically conductive, electrically grounded brush.

10. The apparatus device according to claim 7, wherein said brush is located closely adjacent to but not in contact with said sheet.

11. The apparatus according to claim 10, wherein said brush and said sheet are separated by a gap ranging within 0.5 and 2.0 mm.

12. The apparatus according to claim 7, wherein said brush comprises carbon fibers.

13. The apparatus according to claim 7, wherein said brush is a metal-woven structure.

14. The apparatus according to claim 1, wherein said charge generating device is controlled as to apply said third charge to said sheet, the magnitude of which increases in response to the number of said toner images already transferred onto said sheet.

15. The apparatus according to claim 1, further comprising roller means for determining at the point of separation of said sheet from said member a path for said member which curves away from said sheet with a radius less than 50 mm.

16. The apparatus according to claim 15, wherein said radius is less than 25 mm.

17. The apparatus according to claim 1, wherein said charge generating device comprises for each of said toner images a corona generator, located after said transfer device and on the same side of said sheet, for applying a third charge to said sheet of a polarity which is opposite to that produced by said transfer device.

18. The apparatus according to claim 1, wherein said member is a photoconductor.

* * * * *